US006938664B2

(12) United States Patent
Hsu

(10) Patent No.: US 6,938,664 B2
(45) Date of Patent: Sep. 6, 2005

(54) FOLDING BLIND STRUCTURE

(75) Inventor: Pey-Son Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 10/440,197

(22) Filed: May 19, 2003

(65) Prior Publication Data

US 2004/0231802 A1 Nov. 25, 2004

(51) Int. Cl.[7] ..... E06B 3/48
(52) U.S. Cl. ..... 160/84.05; 156/292; 156/308.4
(58) Field of Search ..... 160/84.04, 84.05, 160/179, 89; 156/201, 292, 308.4, 309.6

(56) References Cited

U.S. PATENT DOCUMENTS 2,201,356 A * 5/1940 Terrell ..... 160/84.02
2,350,094 A * 5/1944 Butts ..... 160/84.04
4,685,986 A * 8/1987 Anderson ..... 156/197
5,158,632 A * 10/1992 Colson et al. ..... 156/197
5,205,333 A * 4/1993 Judkins ..... 160/84.02

* cited by examiner

*Primary Examiner*—Blair M. Johnson
(74) *Attorney, Agent, or Firm*—Troxell Law Office, PLLC

(57) ABSTRACT

A folding blind structure has an upper and a lower beams with a pair of overlapping inner and outer blind layers attached there-between wherein the inner blind layer has consecutive large transverse V-shaped folding sections with long adhering sections disposed at the middle thereof, while the outer blind layer has small transverse V-shaped folding sections with short adhering sections disposed at the inner edge thereof. Via rollers clamping tight the long and short adhering sections synchronically for fastening thereof, the inner and outer blind layers are automatically assembled with large hollow arc patterns formed at the front section of the combined inner and outer blind layers, and small hollow arc patterns disposed at the rear side of the large transverse V-shaped folding sections thereof. Besides, the large transverse V-shaped folding sections can also have long adhering sections disposed at the rear side thereof to be fastened tight with the short adhering sections thereof via the clamping of rollers with large hollow arc patterns formed at the front section of the combined inner and outer blind layers thereof.

2 Claims, 7 Drawing Sheets

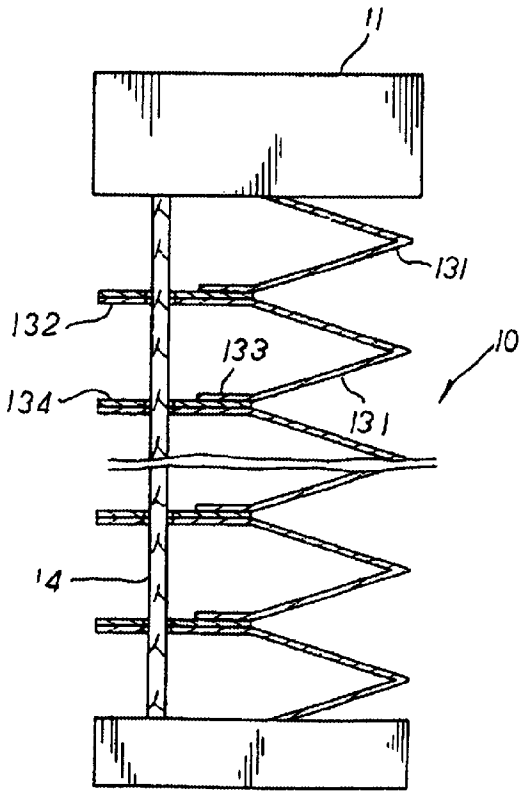
PRIOR ART FIG. 1
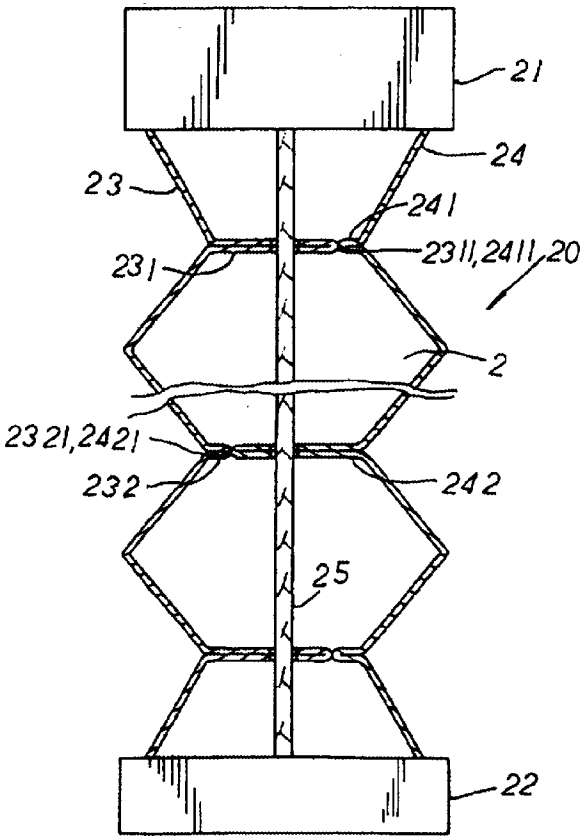
FIG. 2 PRIOR ART

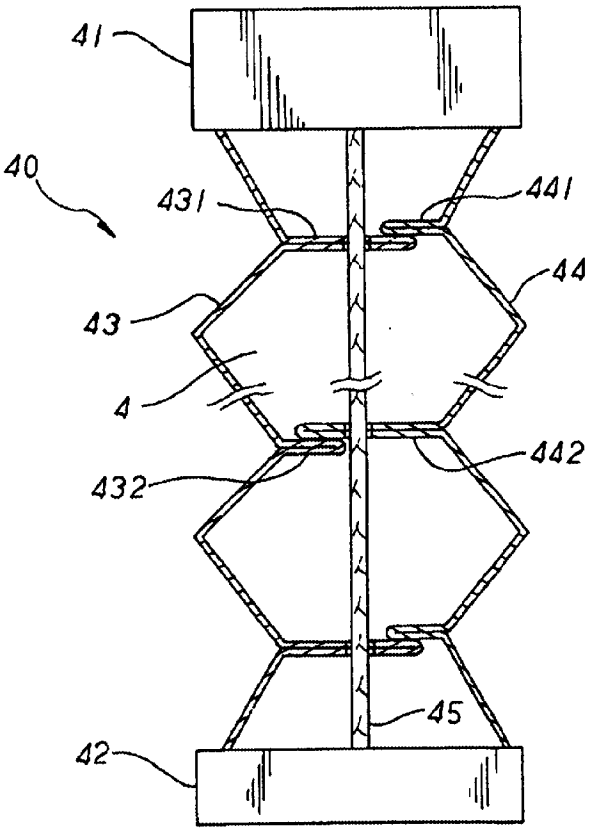
PRIOR ART FIG. 4
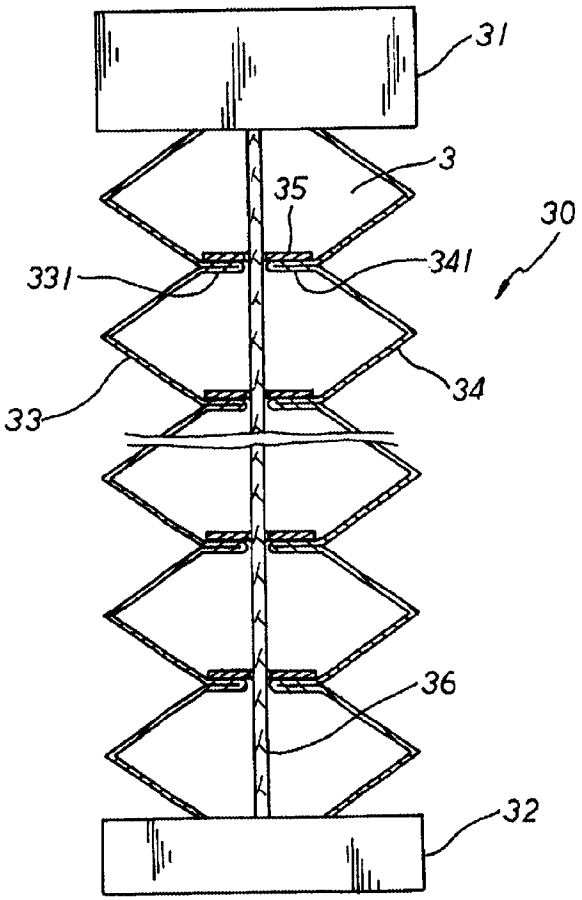
FIG. 3 PRIOR ART

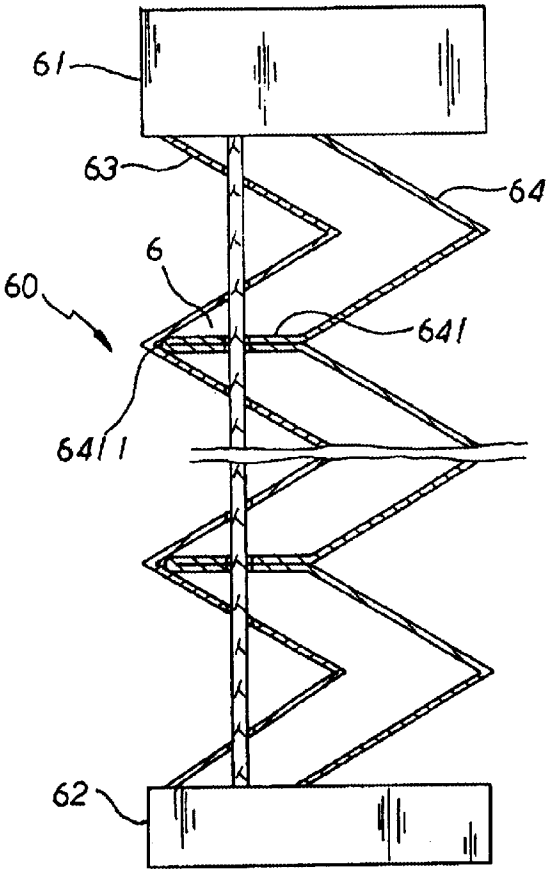
PRIOR ART FIG. 6
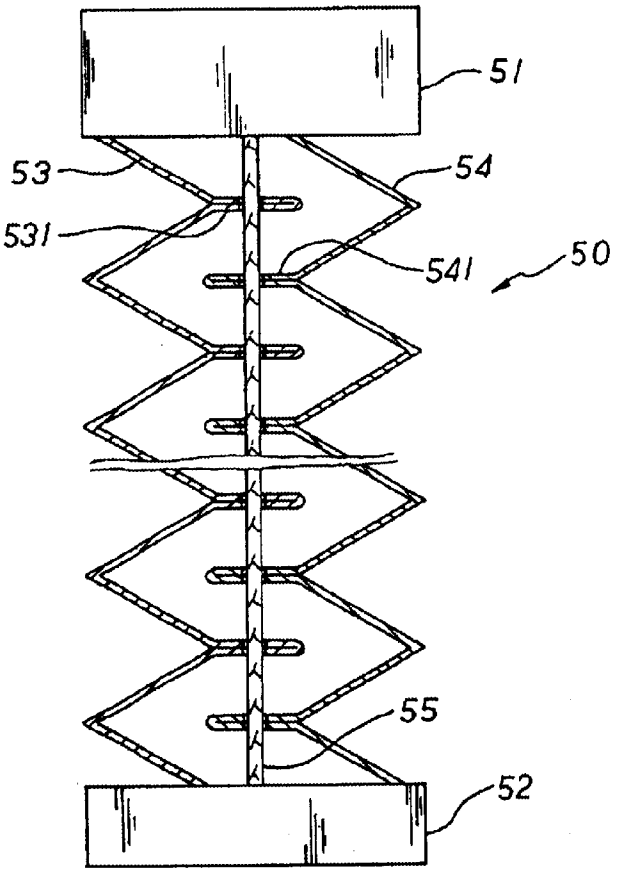
FIG. 5 PRIOR ART

FOLDING BLIND STRUCTURE

BACKGROUND OF THE INVENTION

The present invention is related to a folding blind structure, comprising an upper and a lower beams with a pair of overlapping inner and outer blind layers attached there-between wherein the inner blind layer has consecutive large transverse V-shaped folding sections with long adhering sections disposed at the middle thereof, and the outer blind layer has small transverse V-shaped folding sections with short adhering sections disposed at the inner edge thereof. Via rollers clamping tight the long and short adhering sections synchronically for fastening thereof, the inner and outer blind layers are automatically assembled with large hollow arc patterns formed at the front section thereof, and small hollow arc patterns disposed at the rear side thereof, facilitating the production thereof with ease and speed on a massive scale.

Please refer to FIG. 1. A conventional folding blind structure comprises a folding blind 10 made up of an upper and a lower beams 11, 12 with a plurality of equidistant transverse V-shaped blind units 131 attached there-between. Each transverse V-shaped blind unit 131 has a long fastening edge 132 disposed at the upper side and a short fastening edge 133 disposed at the lower side thereof. Fastening pieces 134, each of the same length with the long fastening edge 132 of the transverse V-shaped blind unit 131, are adapted and sandwiched between the long and short fastening edges 132, 133 of every two transverse V-shaped blind units 131 to fasten the transverse V-shaped blind units 131 consecutively into a blind body 13 which can be gathered up or unfolded via a pulling cord 14.

There are some drawbacks to such conventional folding blind structure. First, the blind body 13 of the folding blind 10 is made up of the transverse V-shaped blind units 131 each attached individually with the others via the fastening pieces 134, which is both troublesome and time-consuming in assembly as well as in production. Thus, hard to produce on a massive scale, it's uncompetitive in the market. Second, the blind body 13 thereof is merely single-layered, which is flatly monotonous in decoration.

Please refer to FIG. 2. A second conventional folding blind 20 has an upper and a lower beams 21, 22 with a pair of corresponding inner and outer blind layers 23, 24 attached there-between. Long and short fastening sections 231, 232 with fastening edges 2311, 2322 are alternatively disposed at one side of the inner blind layer 23 matching to short and long fixing sections 241, 242 with fixing edges 2411, 2422 alternatively disposed at the corresponding inner side of the outer blind body 24. The long fastening sections 231 thereof are matched to the short fixing sections 241 thereof and attached thereto via the fastening edges 2311 and the fixing edges 2411 thereof, while the short fastening section 232 thereof matched to the long fixing section 242 and combined therewith via the fastening edge 2321 and the fixing edge 2421 thereof. The corresponding outer side of the inner and outer blind bodies 23, 24, are folded into consecutive transverse V-shaped patterns; whereby, the inner and outer blind bodies 23, 24 can be gathered up or unfolded via a pulling cord 25.

There are some drawbacks to the second conventional folding blind structure. First, the long and short fastening sections 231, 232 with fastening edges 2311, 2322 as well as the long and short fixing sections 241, 242 with fixing edges 2411, 2422 must be alternatively and consecutively folded at the corresponding inner side of the inner and outer blind bodies 23, 24 thereof, which is quite complicated in production thereof. Besides, each long fastening section 231 is individually attached to the short fixing section 241, and each short fastening section 232 to the long fixing section 242 thereof, which is time-consuming and troublesome in assembly. Finally, it's difficult to securely join the fastening edges 2311, 2321, and the fixing edges 2411, 2421 thereof at the limited space of the corresponding inner side of the inner and outer blind bodies 23, 24. Thus, it's hard to be produced on a massive scale.

Please refer to FIG. 3. A third conventional folding blind structure comprises a folding blind 30 having an upper and a lower beams 31, 32 with a pair of corresponding inner and outer blind layers 33, 34 attached there-between. A plurality of fastening sections 331 are consecutively folded from top to bottom at one side of the inner blind layer 33, matching to fixing sections 341 consecutively folded at the corresponding inner side of the outer blind layer 34 thereof. Coupling pieces 35 are adapted and applied onto the upper surface of the fastening sections 331 and the fixing sections 341 thereof for combination of the inner and outer blind layers 33, 34 thereof. The corresponding outer side of the inner and outer blind layers 33, 34 are folded into consecutive and transverse V-shaped patterns; whereby, the folding blind 30 can be gathered up or unfolded via a pulling cord 36.

There are some disadvantages to the third conventional folding blind structure. First, the inner and outer blind layers 33, 34 are consecutively folded and fastened inwards to form fastening sections 331, and fixing sections 341 thereof respectively, which is uneconomically time-consuming and troublesome in production. Besides, the fastening sections 331 and fixing sections 341 thereof are individually combined via coupling pieces 35 and assembled at the limited space of the corresponding inner side of the inner and outer blind layers 33, 34. Thus, hard for massive production, it's uncompetitive in the market.

Please refer to FIG. 4. A fourth conventional folding blind structure comprises a folding blind 40 having an upper and a lower beams 41, 42 with a pair of corresponding inner and outer blind layers 43, 44 attached there-between. Long and short fastening sections 431, 432 are alternatively folded from top to bottom at one side of the inner blind layer 43, while short and long fixing sections 441, 442 are alternatively disposed at the corresponding inner side of the outer blind layer 44. The short fixing sections 441 thereof are applied on top of the long fastening sections 431 thereof, and the long fixing sections 442 on top of the short fastening sections 432 for combination of the inner and outer blind layers 43, 44 thereof. The corresponding outer side of the inner and outer blind layers 43, 44 are folded into consecutive and transverse V-shaped patterns; whereby, the folding blind 40 can be gathered up or unfolded via a pulling cord 45.

There are some disadvantages to the fourth conventional folding blind structure. Most of all, the long and short fastening sections 431, 432 are alternatively folded from top to bottom of the inner blind layer 43 and then individually attached to the bottom of alternatively folded short and long fixing sections 441, 442 of the outer blind layer 44, which likewise is troublesome and time-consuming in production and assembly. Besides, the long and short fastening sections 431, 432 thereof are attached to the short and long fixing sections 441, 442 respectively at the limited space disposed at the corresponding inner side of the inner and outer blind layers 43, 44. Thus, it's uneconomically hard to be produced on a massive scale, which makes it uncompetitive in the market.

Please refer to FIG. 5. A fifth conventional folding blind structure comprises a folding blind 50 having an upper and a lower beams 51, 52 with a pair of parallel inner and outer blind layers 53, 54 attached there-between. The corresponding inner side of the parallel inner and outer blind layers 53, 54 are consecutively folded from top to bottom into a plurality of fastening sections 531 and fixing sections 541 respectively with the fastening sections 531 thereof arranged alternatively with the fixing sections thereof. The corresponding outer side of the parallel inner and outer blind layers 53, 54 are folded into consecutive and transverse V-shaped patterns; whereby, the folding blind 50 can be gathered up or unfolded via a pulling cord 55.

The fifth conventional folding blind structure also shows some disadvantages. Most of all, the fastening sections 531 and the fixing sections 541 thereof are individually folded from top to bottom of the inner and the outer blind layers 53, 54 respectively, and then arranged alternatively one with the others. Thus, it's uneconomically troublesome and time-consuming in production as well as in assembly, which makes it uncompetitive in the market.

Please refer to FIG. 6. A sixth conventional folding blind structure comprises a folding blind 60 having an upper and a lower beams 61, 62 with a pair of parallel inner and outer blind layers 63, 64 attached there-between. The outer blind layers 64 are provided with a plurality of fastening sections 641 with fastening ends 6411 equidistantly folded inwards from top to bottom thereof. The parallel inner and outer blind layers 63, 64 are combined via the fastening ends 6411 of the fastening sections 641 thereof attached to the corresponding inner side of the inner blind layer 63 thereof. The corresponding outer sides of the parallel inner and outer blind layers 63, 64 thereof are folded into consecutive and transverse V-shaped patterns; whereby, the folding blind 60 thereof can be gathered up or unfolded via a pulling cord 65.

The sixth conventional folding blind structure is characterized by that the fastening sections 641 with fastening ends 6411 are individually folded from top to bottom of the outer blind layer 64, and attached one by one onto the inner blind layer 63 at the limited space 6 of the corresponding inner side of the inner and outer blind layers 63, 64. Thus, the sixth conventional folding blind structure is likewise troublesome and time-consuming in production and in assembly, which makes it hard to be produced on a massive scale.

SUMMARY OF THE PRESENT INVENTION

It is, therefore, the primary purpose of the present invention to provide a folding blind structure, comprising an upper and a lower beams with a pair of overlapping inner and outer blind layers securely attached there-between wherein the inner blind layer has consecutive large transverse V-shaped folding sections with long adhering section disposed at the middle thereof, and the outer blind layer has small transverse V-shaped folding sections with short adhering sections disposed at the inner edge thereof. Via rollers clamping tight the long and the short adhering sections synchronically for fastening thereof, the inner and outer blind layers are automatically assembled with ease and speed, facilitating the production of the present invention on a massive scale.

It is, therefore, the secondary purpose of the present invention to provide a folding blind structure wherein the small transverse V-shaped folding sections of the outer blind layer are bent in smaller folds than the large transverse V-shaped folding sections of the inner blind layer thereof. When rollers clamping tight the long and short adhering sections synchronically for combination of the inner and outer blind layers, large hollow arc patterns are automatically formed at the front section thereof, and small hollow arc patterns are disposed at the rear side thereof, facilitating the beauty and variety of the present invention in display.

BRIEF DESCRIPTION OF THE DRAWINGS

FIG. 1 is a sectional view of a first conventional folding blind structure.

FIG. 2 is a sectional view of a second conventional folding blind structure.

FIG. 3 is a sectional view of a third conventional folding blind structure.

FIG. 4 is a sectional view of a fourth conventional folding blind structure.

FIG. 5 is a sectional view of a fifth conventional folding blind structure.

FIG. 6 is a sectional view of a sixth conventional folding blind structure.

DETAILED DESCRIPTION OF THE PREFERRED EMBODIMENTS

Figure 7:
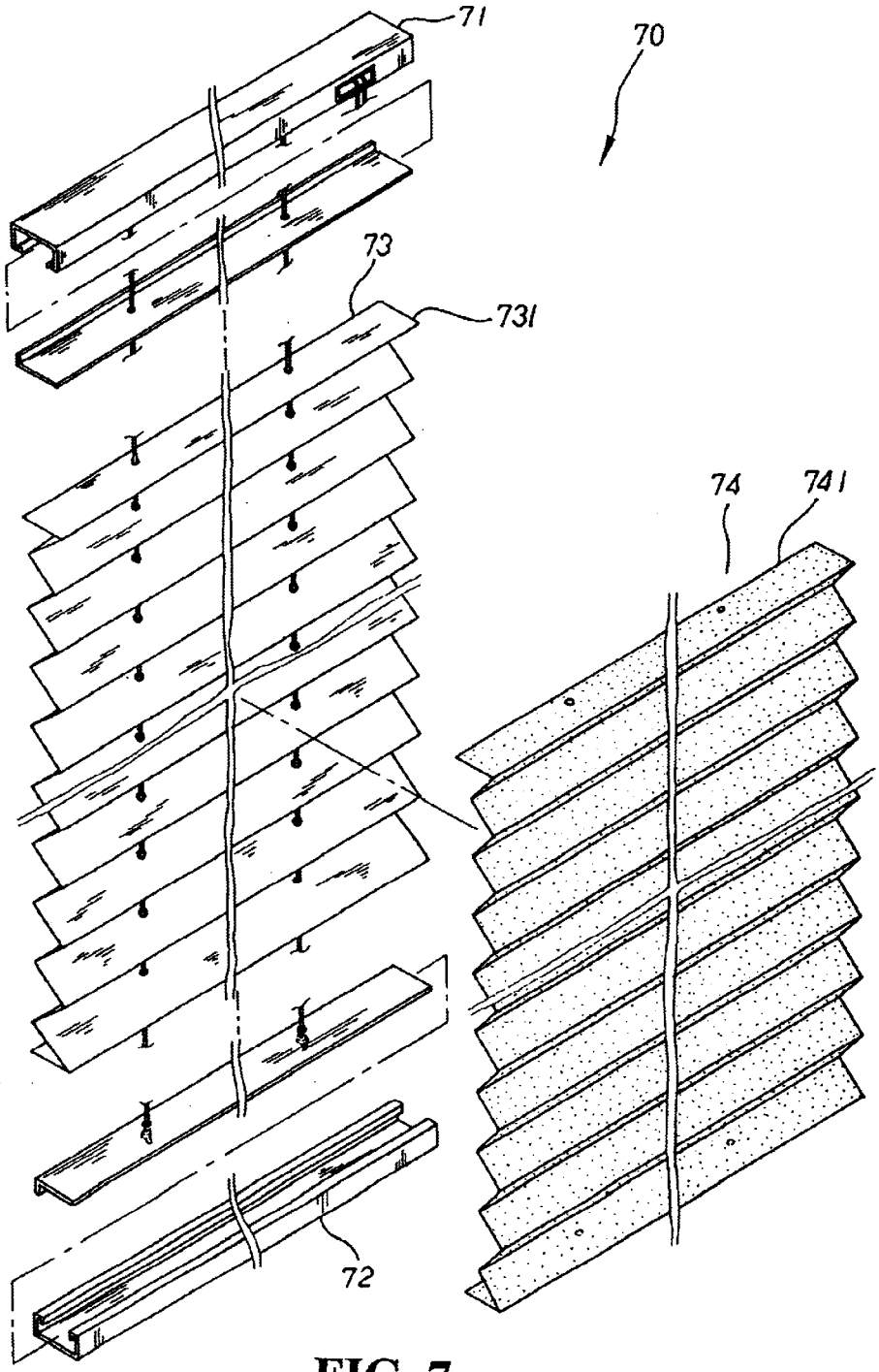
FIG. 7 is a perspective exploded view of the present invention.
Figure 8:
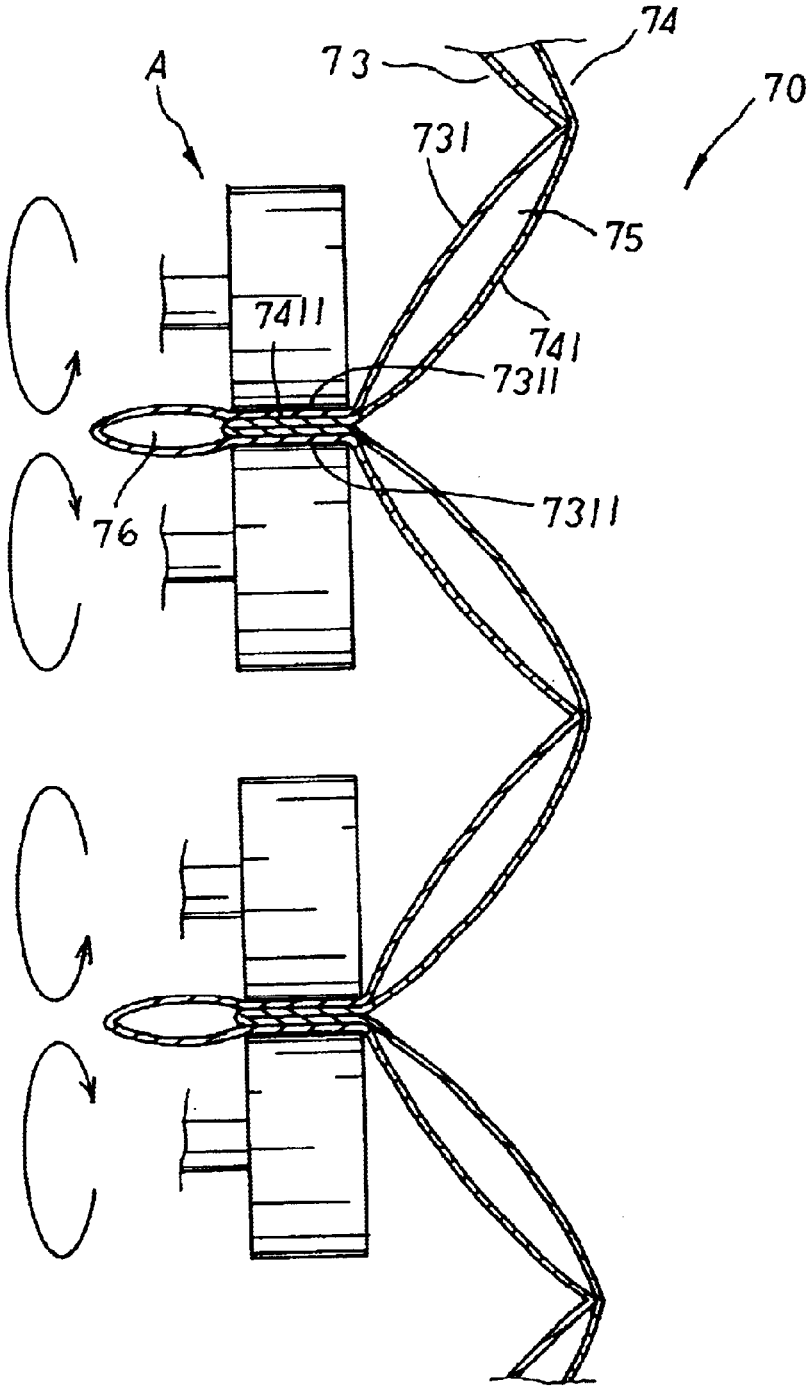
FIG. 8 is a sectional view showing the combination of the inner and the outer blind layers of the present invention.
Figure 9:
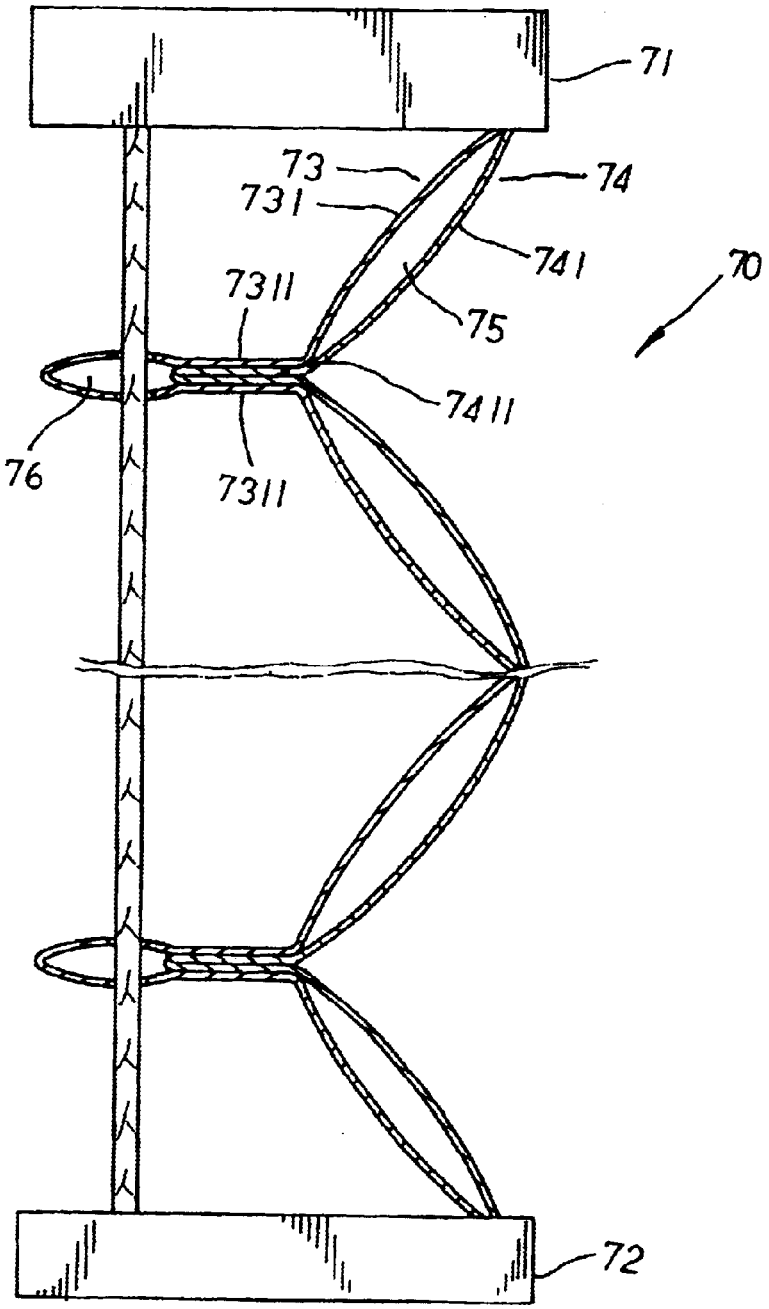
FIG. 9 is a sectional view of the present invention.

Please refer to FIGS. 7, 8. The present invention is related to a folding blind structure, comprising a folding blind 70 made up of an upper and a lower beams 71, 72, and an inner and outer blind layers 73, 74 securely attached to the upper and lower beams 71, 72 thereof. The inner blind layer 73 is folded into a plurality of consecutive large transverse V-shaped folding sections 731, while the outer blind layer 74 has small transverse V-shaped folding sections 741 consecutively bent in smaller folds than the large transverse V-shaped folding sections 731 of the inner blind layer 73 thereof. Each large transverse V-shaped folding section 731 thereof is provided with a long adhering section 7311 disposed at the middle thereof, while each small transverse V-shaped folding section 741 has a short adhering section 7411 disposed at the inner edge thereof. Rollers A are adapted to clamp tight the long and short adhering sections 7311, 7411 thereof and fasten the large and the small transverse V-shaped folding sections 731, 741 therewith for combination of the inner and outer blind layers 73, 74 thereof. Meanwhile, large hollow arc patterns 75 are formed at the front section thereof, defined by the combined inner and outer blind layers 73, 74, while small hollow arc patterns 76 arc disposed at the rear section of the large transverse V-shaped folding sections 731 thereof as shown in FIG. 9.

Figure 10:
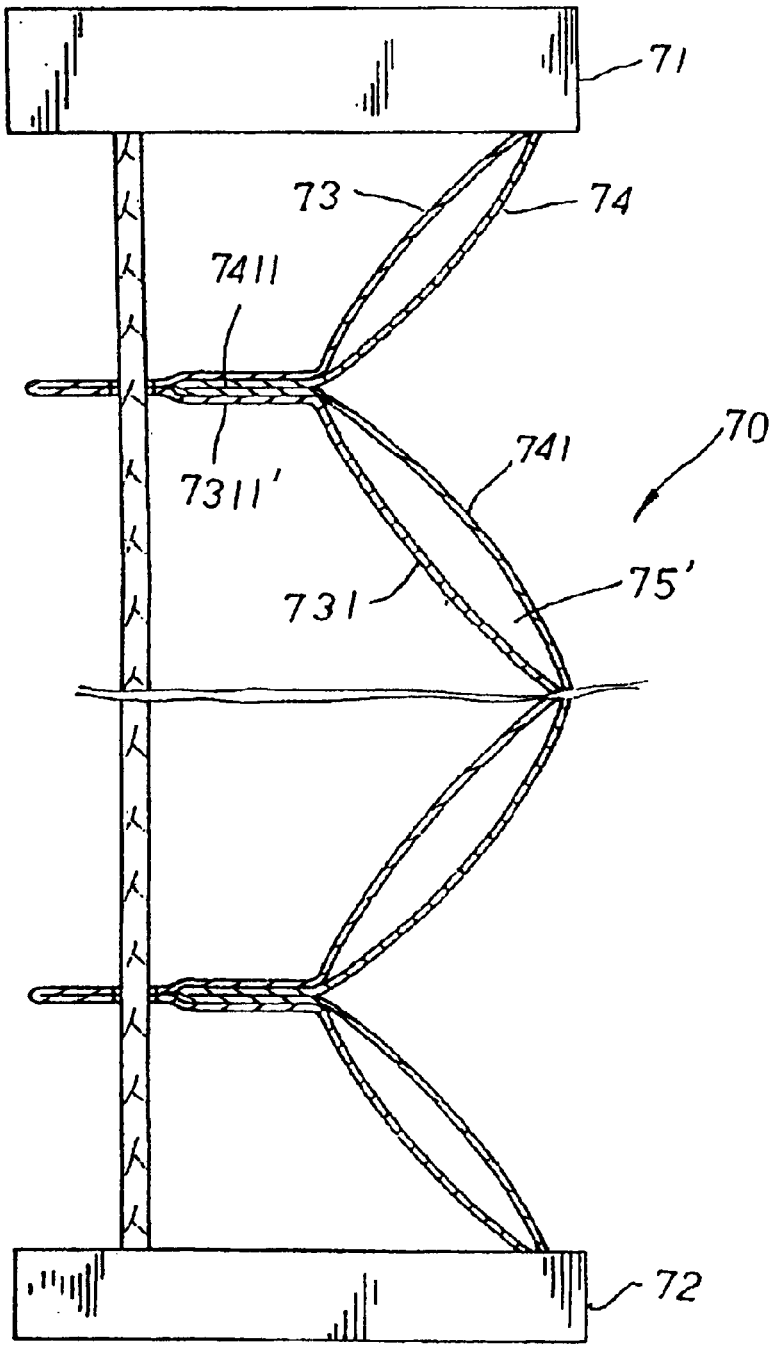
FIG. 10 is a sectional view showing another embodiment of the present invention.

Please refer to FIG. 10. The rear side of the large transverse V-shaped folding sections 731 have long adhering sections 7311' to be fastened tight with the short adhering sections 7411 via rollers A thereof for combination of the inner and outer blind layers 73, 74. Meanwhile, large hollow arc patterns 75' are formed at the front section of the combined inner and outer blind layers 73, 74. Thus, via rollers A clamping tight the long and short adhering parts 7311, 7411 synchronically for fastening thereof, the inner and outer blind layers 73, 74 can be automatically assembled with ease and speed, facilitating the massive production of the folding blind 70 thereof.

What is claimed is:

1. A folding blind structure comprising:

a) an upper beam;

b) a lower beam;

c) an inner blind layer located between the upper beam and the lower beam and having a plurality of consecutive first transverse V-shaped folding sections and a plurality of first adhering sections, each of the plurality of first adhering sections protrudes from a rear of one of the plurality of consecutive first transverse V-shaped folding sections; and d) an outer blind layer located between the upper beam and the lower beam and having a plurality of consecutive second transverse V-shaped folding sections and a plurality of second adhering sections, each of the plurality of second adhering sections protrudes from a rear of one of the plurality of consecutive second transverse V-shaped folding sections;

wherein each of the plurality of first adhering sections is connected to one of the plurality of second adhering sections, further comprising a plurality of rear hollow arc patterns, each located on a rear section of one of the plurality of consecutive first transverse V-shaped folding sections.

2. A folding blind structure comprising:

a) an upper beam;

b) a lower beam;

c) an inner blind layer located between the upper beam and the lower beam and having a plurality of consecutive first transverse V-shaped folding sections and a plurality of first adhering sections, each of the plurality of first adhering sections protrudes from a rear of one of the plurality of consecutive first transverse V-shaped folding sections; and d) an outer blind layer located between the upper beam and the lower beam and having a plurality of consecutive second transverse V-shaped folding sections and a plurality of second adhering sections, each of the plurality of second adhering sections protrudes from a rear of one of the plurality of consecutive second transverse V-shaped folding sections, wherein each of the plurality of first adhering sections is connected to one of the plurality of second adhering sections, further comprising a plurality of front hollow arc patterns, each located on a front section of and between one of the plurality of consecutive first transverse V-shaped folding sections and an adjacent one of the plurality of consecutive second transverse V-shaped folding sections.

* * * * *